US007837272B2

(12) United States Patent
Masunaga et al.

(10) Patent No.: US 7,837,272 B2
(45) Date of Patent: Nov. 23, 2010

(54) CHAIR AND THE STRUCTURE FOR STRETCHING A MESH OVER AN ELEMENT OF THE CHAIR

(75) Inventors: Hiroshi Masunaga, Yokohama (JP); Tetsuya Narita, Funabashi (JP); Ryo Igarashi, Tokyo (JP); Akira Kiyoku, Yokosuka (JP); Ken Nakayama, Yokohama (JP)

(73) Assignee: Okamura Corporation (JP)

( * ) Notice: Subject to any disclaimer, the term of this patent is extended or adjusted under 35 U.S.C. 154(b) by 187 days.

(21) Appl. No.: 11/577,283

(22) PCT Filed: Oct. 12, 2005

(86) PCT No.: PCT/JP2005/018771

§ 371 (c)(1),
(2), (4) Date: Aug. 23, 2007

(87) PCT Pub. No.: WO2006/041078

PCT Pub. Date: Apr. 20, 2006

(65) Prior Publication Data

US 2008/0284229 A1 Nov. 20, 2008

(30) Foreign Application Priority Data

Oct. 13, 2004 (JP) ..... 2004-299233
Oct. 13, 2004 (JP) ..... 2004-299234
Oct. 13, 2004 (JP) ..... 2004-299344

(51) Int. Cl.
*A47C 7/02* (2006.01)
*A47C 31/00* (2006.01)

(52) U.S. Cl. ..... 297/452.56; 297/452.18; 297/218.1

(58) Field of Classification Search ..... 297/218.1, 297/218.3, 218.5, 296, 298, 299, 300.1, 300.2, 297/301.1, 440.11, 452.18, 452.55, 452.56, 297/452.59, 452.63, 284.4; D6/364, 365, D6/366
See application file for complete search history.

(56) References Cited

U.S. PATENT DOCUMENTS 3,088,517 A * 5/1963 Schwartz et al. ..... 160/184

(Continued)

FOREIGN PATENT DOCUMENTS

JP 9-10189 U 6/1978

(Continued)

OTHER PUBLICATIONS

PCT International Search dated Jan. 24, 2006 issued in corresponding PCT Application No. PCT/JP2005/018771.
European Search Report dated Mar. 23, 2009.

*Primary Examiner*—Sarah B McPartlin
(74) *Attorney, Agent, or Firm*—Ostrolenk Faber LLP

(57) ABSTRACT

An upholstered structure including an upholstery material for a chair or a backrest of a chair is proposed, which may achieve: reduced proportion of the appearance of the rear frame of the backrest over the appearance of the whole chair; more sophisticated design; reduced weight; reduced number of parts; and improved assemble-ability. In the chair having the backrest upholstered with the upholstery material over the front surface of the rear frame, the rear frame comprises a front frame to which the peripheral edge part of the upholstery material is fixed and an upper reinforcement frame rod. The laterally facing upper reinforcement frame rod is connected at its both ends to both ends of the laterally facing upper frame rod at the top of the front frame with the center part of the upper reinforcement frame rod separated backward from the upper frame rod.

14 Claims, 10 Drawing Sheets

U.S. PATENT DOCUMENTS

| | | | | |
|---|---|---|---|---|
| 3,175,269 | A * | 3/1965 | Raduns et al. | 24/265 C |
| 3,363,667 | A * | 1/1968 | Thomas et al. | 160/327 |
| 4,541,150 | A * | 9/1985 | Brokmann | 24/265 C |
| 5,582,463 | A * | 12/1996 | Linder et al. | 297/452.2 |
| 6,050,646 | A * | 4/2000 | Stenzel et al. | 297/452.59 |
| 6,231,125 | B1 * | 5/2001 | Maeda et al. | 297/452.56 |
| 6,254,190 | B1 | 7/2001 | Gregory | 297/452.1 |
| 6,345,428 | B2 * | 2/2002 | Apissomian | 29/428 |
| 6,375,269 | B1 * | 4/2002 | Maeda et al. | 297/452.56 |
| 6,386,634 | B1 | 5/2002 | Stumpf et al. | 297/300.4 |
| 6,406,093 | B1 * | 6/2002 | Miotto et al. | 297/218.5 |
| 6,439,661 | B1 * | 8/2002 | Brauning | 297/300.2 |
| D482,205 | S * | 11/2003 | Englisch et al. | D6/366 |
| 6,761,406 | B2 * | 7/2004 | Kinoshita et al. | 297/296 |
| D505,798 | S * | 6/2005 | Seiler | D6/366 |
| 7,147,288 | B2 * | 12/2006 | Grasse et al. | 297/452.2 |
| 2003/0001425 | A1 * | 1/2003 | Koepke et al. | 297/452.56 |
| 2004/0012237 | A1 * | 1/2004 | Horiki et al. | 297/440.11 |
| 2004/0124689 | A1 | 7/2004 | Numa et al. | 297/452.56 |
| 2005/0062323 | A1 * | 3/2005 | Dicks | 297/284.4 |

FOREIGN PATENT DOCUMENTS

| | | |
|---|---|---|
| JP | 5-7179 | 2/1993 |
| JP | 6-45553 | 6/1994 |
| JP | 11-155690 | 6/1999 |
| JP | 2003-510115 | 3/2003 |
| JP | 2003-284625 | 10/2003 |
| JP | 2004-49685 | 2/2004 |
| JP | 2004-159745 | 6/2004 |
| JP | 2004-188009 | 7/2004 |
| WO | WO 02/102197 | 12/2002 |

* cited by examiner

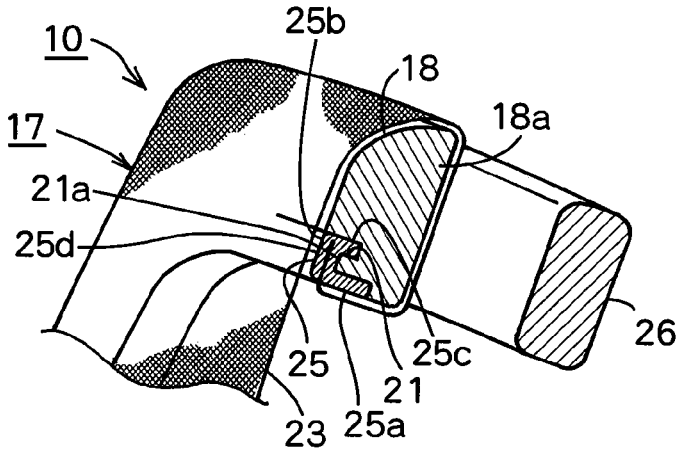
FIG.6
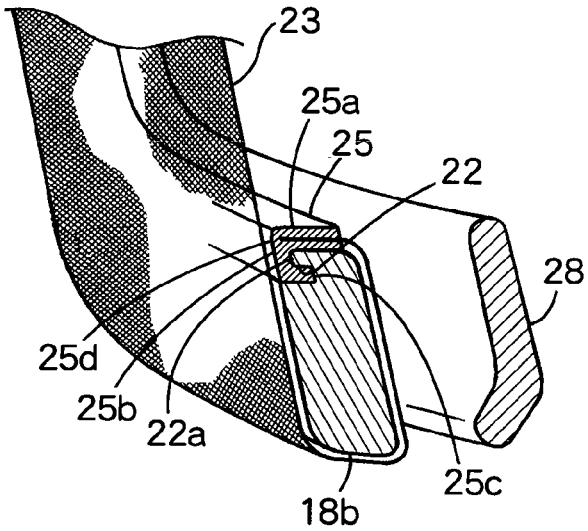
FIG.7
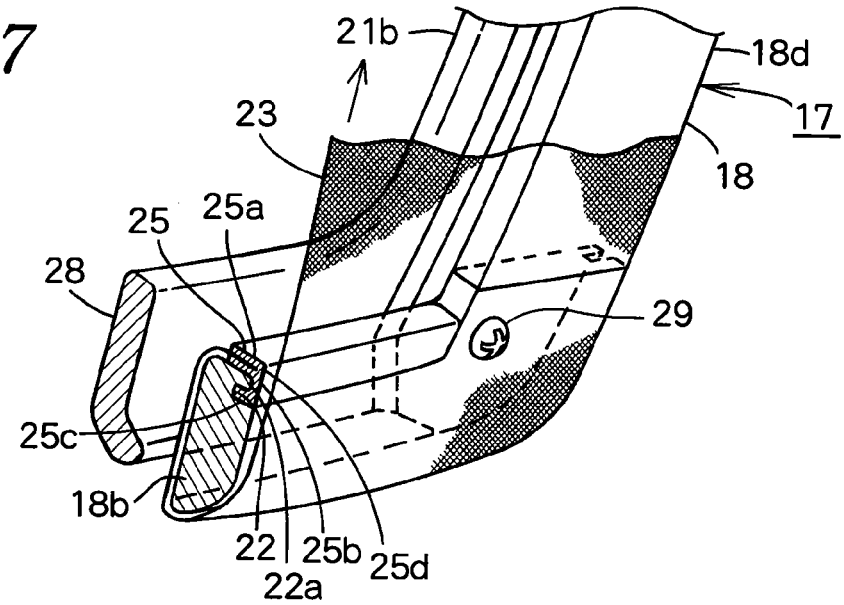

CHAIR AND THE STRUCTURE FOR STRETCHING A MESH OVER AN ELEMENT OF THE CHAIR

CROSS REFERENCE TO RELATED APPLICATION

The present application is a 35 U.S.C. "371 national phase conversion of PCT/JP 2005/018771, filed 12 Oct. 2005, which claims priority of Japanese Patent Application No. 2004-299233, filed 13 Oct. 2004, Japanese Patent Application No. 2004-299234, filed 13 Oct. 2004 and Japanese Patent Application No. 2004-299244, filed 13 Oct. 2004. The PCT International Application was published in the Japanese language.

TECHNICAL FIELD

The present invention relates to a chair and the structure for stretching a mesh over the backrest, a seat, a headrest etc. of the chair.

BACKGROUND OF THE INVENTION

U.S. Pat. No. 6,386,634B1 discloses the backrest structure of a chair and the stretching structure of a mesh in the backrest in which edge material is mounted by molding around the mesh to which tension is already applied, the edge material engaging in grooves in a front surface of a back frame to apply mesh over the front surface of the back frame.

JP2004-49685A discloses that an engagement piece mounted to the periphery of a mesh engages on a peripheral groove on the rear surface of a back frame, said engagement piece being pressed into the groove by the binding frame mounted to the rear surface of the back frame to apply tension to the mesh over the upper surface of the back frame.

A hanger for having clothes of a sitting person is mounted to the backrest of a chair in JP6-45553U, JP2004-159745A, JP9-10189U, JP11-155690A and JP5-7179U.

PROBLEMS TO BE SOLVED BY THE INVENTION

However, U.S. Pat. No. 6,386,634B1 discloses that it is necessary to take the width of the back frame to prevent flexure of the back frame by force applied to the mesh when the user sits down, a groove which engages with the edge material around the mesh being formed on the front surface of the back frame so that the periphery of the back frame is exposed from the mesh. The back frame greatly occupying the appearance of the chair causes bad appearance in design.

In JP2004-49685A, when a user sits down on the chair, flexing of the back frame against the force applied to the mesh is prevented by both the back frame and binding frame. Thus, the back frame covered with the mesh and binding frame not covered with the mesh are overlapped and exposed to the outside, which does not produce good appearance in design as well as heavy weight, a lot of the parts, a lot of time for assembling and high cost.

In JP6-45553U and JP2004-159745A, the support rod for supporting the hanger body is directly mounted in the middle of the rear surface of the backrest. It cannot be applied to a chair in which mesh is applied to the back frame. And a special device is required so that the mounting parts do not project from the front surface of the backrest when the support rod is directly attached to the middle of the rear surface of the backrest.

In JP9-10189U, JP11-155690A and JP5-7179U, the support rod is mounted to the transverse rod at the lower part of the rear of the backrest or support post standing from the lower part thereby increasing the length of the support rod. When the chair is pulled with the hunger body, the hanger is likely to be broken.

SUMMARY OF THE INVENTION

In view of the above disadvantages in the prior art, it is objects of the present invention to solve the problems below:

(A) To provide a chair with the backrest structure in which the ratio of the back frame is small with respect to the appearance of the chair, having good design, light weight, reduction in the number of parts and improvement in assembling.

(B) To provide a chair with a hanger in which the hanger is easily mounted to the backrest to allow parts for mounting the hanger not to project from the front surface of the backrest, preventing the hanger from being damaged and providing good appearance.

(C) To provide the structure for a mesh over the backrest of a chair in which the ratio of a frame to appearance of the chair is small to provide good appearance, light weight, reduction in the number of parts and improvement in assembling.

BRIEF DESCRIPTION OF THE DRAWINGS

FIG. 6 is a sectional view taken along the line VI-VI in FIG. 4;

FIG. 7 is an enlarged perspective view of the part VII in FIG. 4;

DETAILED DESCRIPTION OF PREFERRED EMBODIMENTS

FIGS. 1-7 show the first embodiment of the present invention.

The present application is applied to the structure of the backrest of the chair and the structure of mesh in the backrest.

Figure 1:
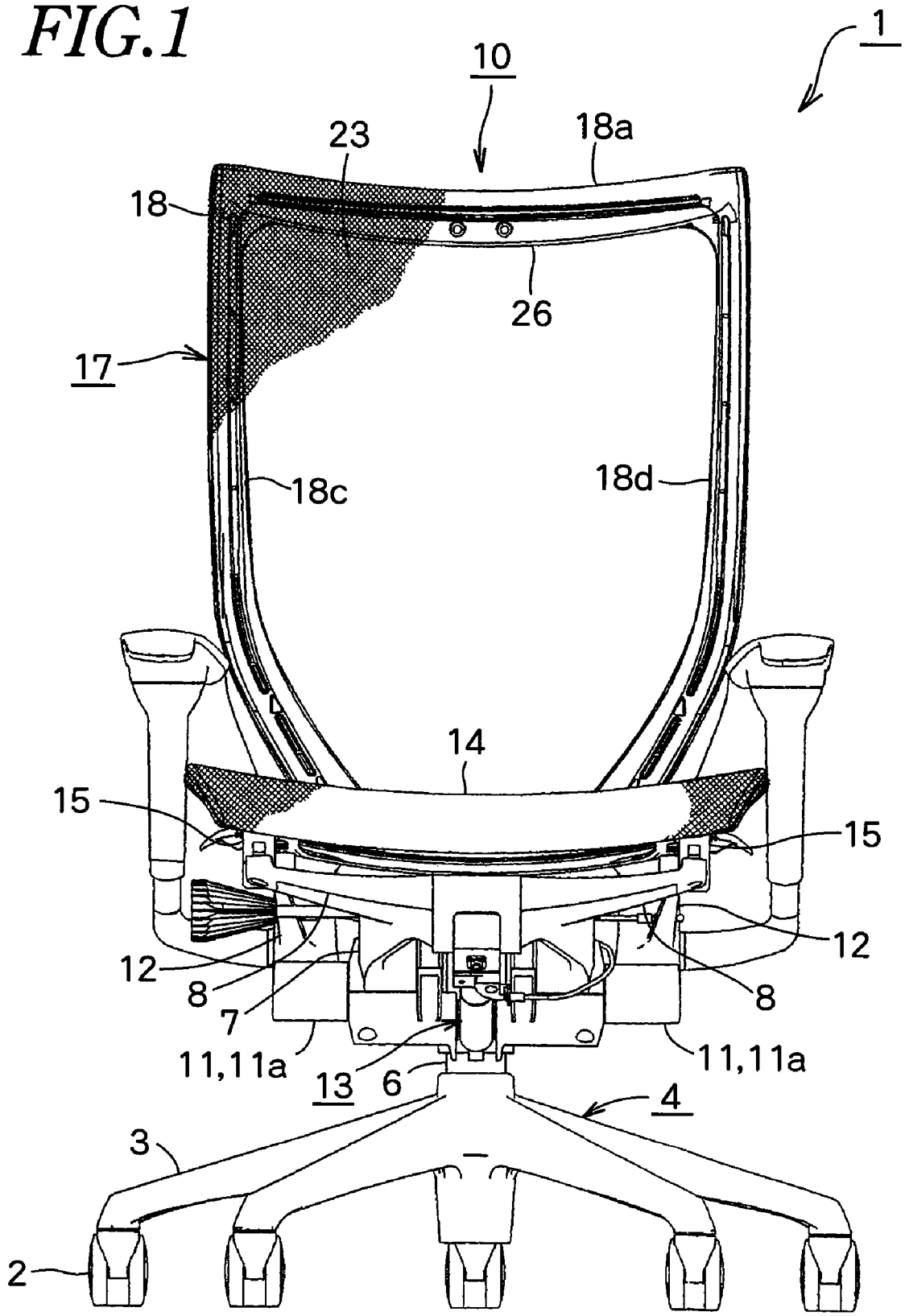
FIG. 1 is a front elevational view of the first embodiment of a chair according to the present invention.
Figure 2:
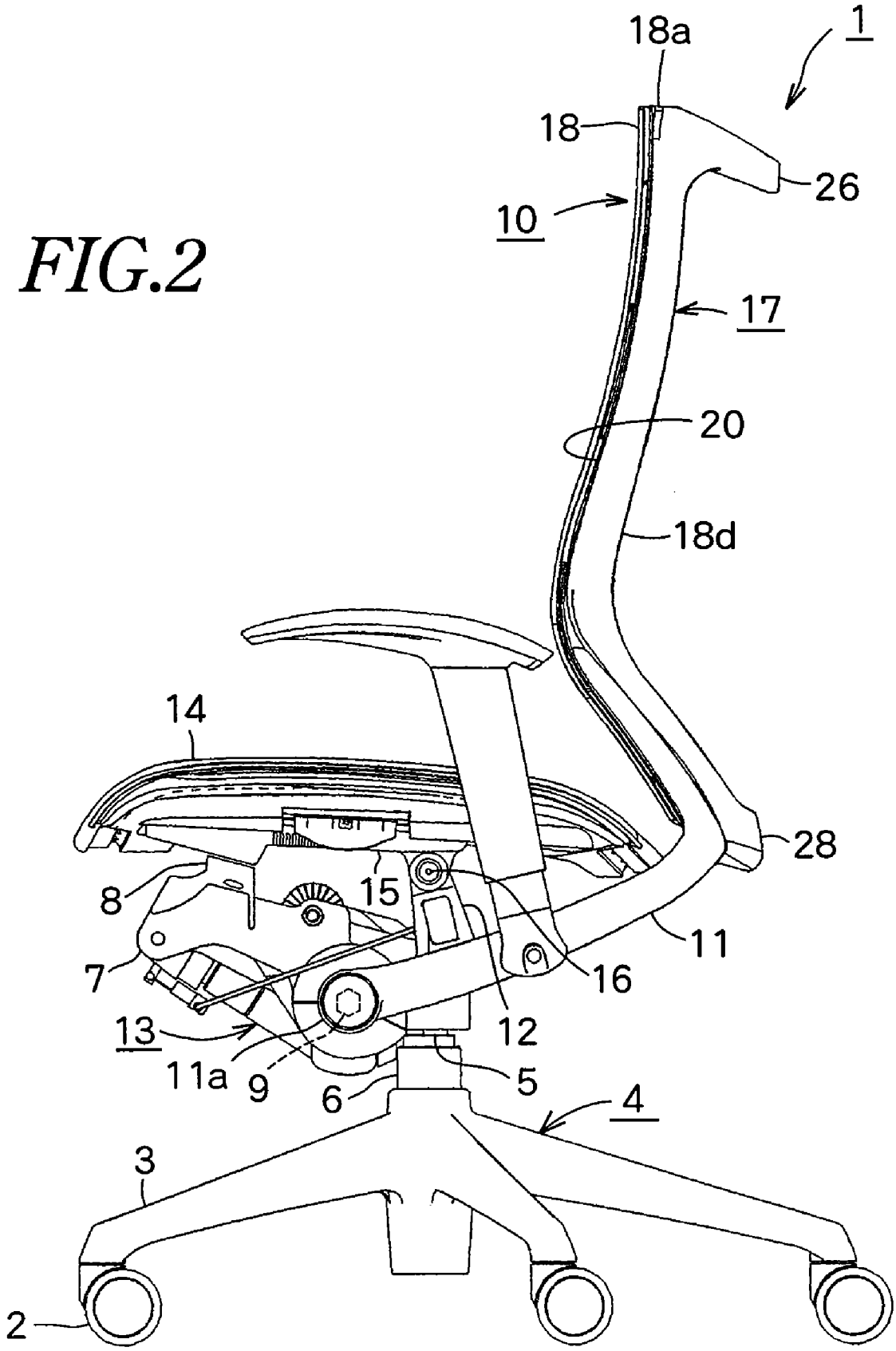
FIG. 2 is a side elevational view thereof.

As shown in FIGS. 1 and 2, a reclining chair 1 comprises a leg 4 comprising five leg rods 3 each of which has a caster 2 at the end. At the center of the leg 4, a telescopic leg post 6 which comprises a gas spring 5 stands. At the upper end of the leg post 6, a rear part of a support base 7 is fixed.

The support base 7 comprises a hollow rhombus-like box which opens at an upper front part, and arms 8,8 are integrally formed from each side of the front part of the support base 7.

A hexagonal pivot 9 passes through the support base 7 in the middle. At each end of the pivot 9 extending from the support base 7, a tubular portion 11*a* fits. The tubular portions 11*a* are provided at the lower front ends of a pair of backrest support rods 11,11 that support a backrest 10. The backrest 10, the backrest support rods 11,11 and the backrest 10 are rotated around the pivot 9 with respect to the support base 7.

Inside the support base 7, there are provided a rubber torsion unit for promoting the pivot 8 in an anticlockwise direction and a promoting-force adjusting device (not shown). In the middle of the front lower surface of the support base 7, there is a gas spring unit 13 for assisting promoting force of the rubber torsion unit in connection with the rubber torsion unit to form a force-promoting unit to stand the backrest 10.

Short arms 12,12 project from the backrest support rods 11,11 at the back of the pivot 9. At the upper ends of the arms 12,12, a pair of seat-supporting frames 15,15 which support each side of a seat 14 are connected at the rear ends with a shaft 16.

The backrest 10 will be described with respect to FIGS. 3-7.

Figure 3:
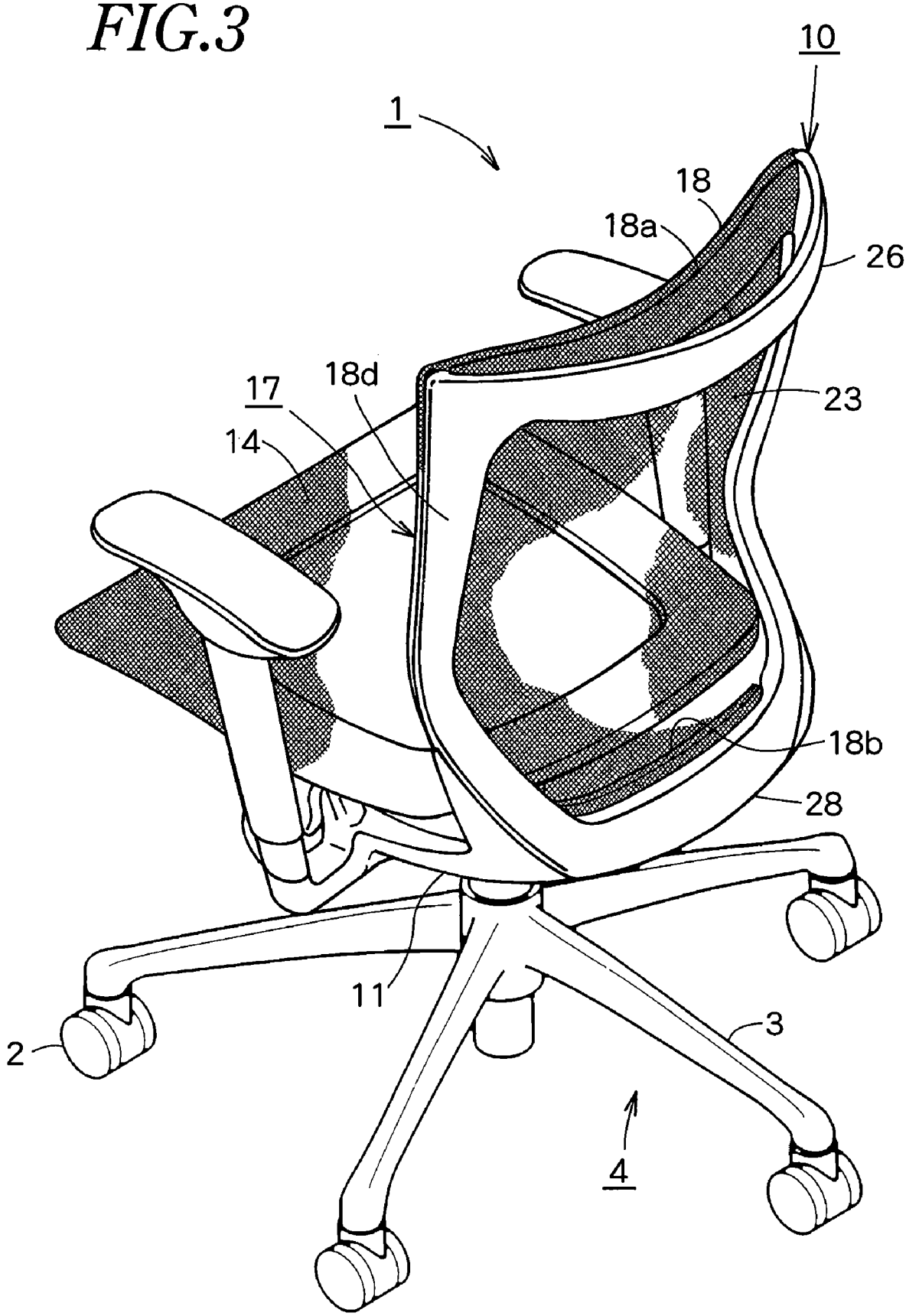
FIG. 3 is a rear perspective view thereof.

In FIG. 3, a back frame 17 of the backrest 10 comprises a rectangular synthetic-resin front face frame 18. The front face frame 18 comprises an upper frame rod 18*a*, a lower frame rod 18*b*, a left-side frame rod 18*c* and a right-side frame rod 18*d*. The rods 18*b*,18*d* are wider than the rods 18*a*,18*b*. A mesh is held on the rods 18*a*,18*b*,18*c*,18*d*.

Figure 4:
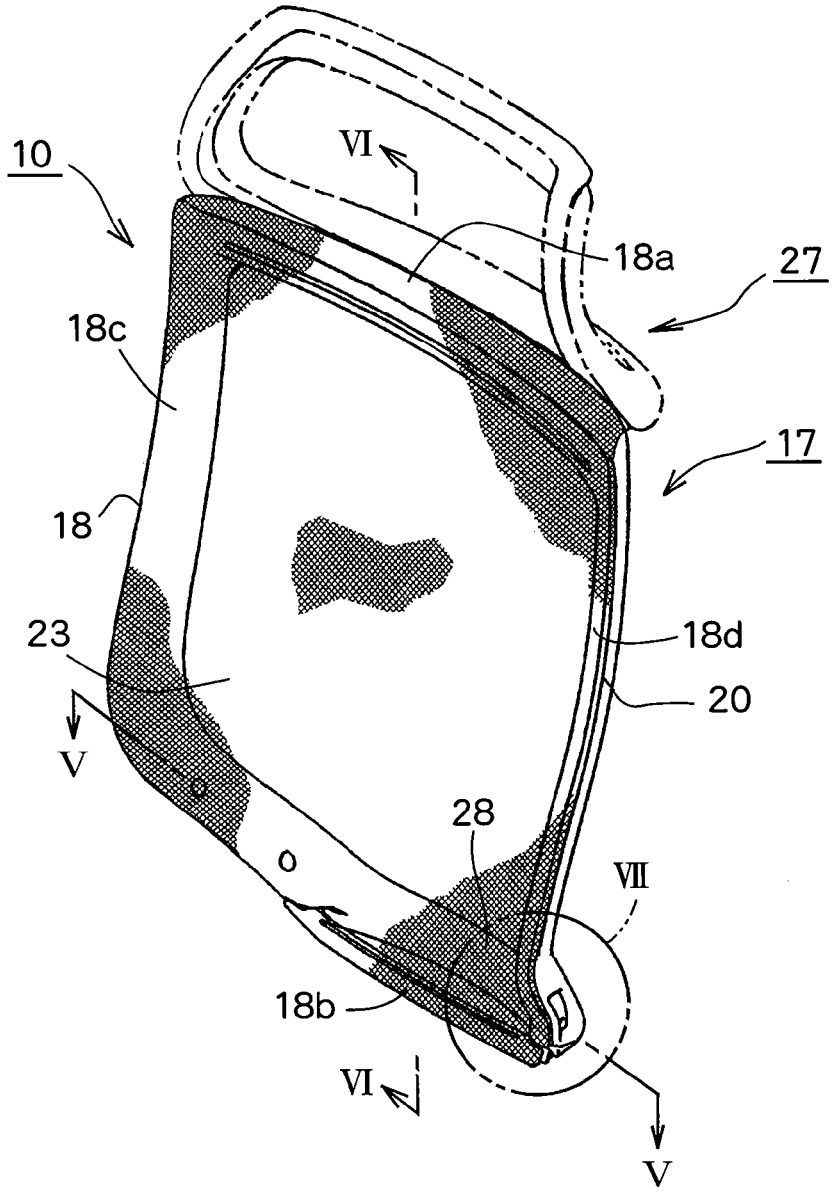
FIG. 4 is a front perspective view of the backrest.
Figure 5:
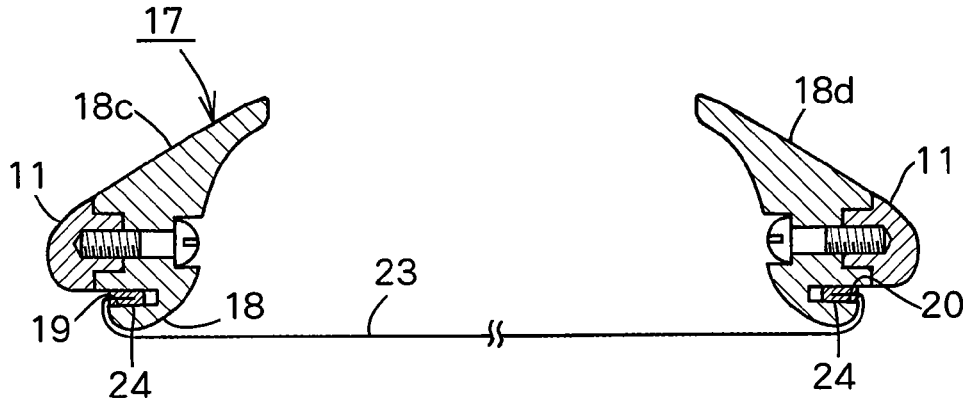
FIG. 5 is a sectional view taken along the line V-V in FIG. 4.

In FIGS. 4 and 5, a pair of grooves 19,20 is formed longitudinally on the outer side surfaces of the right and left side frame rods 18*c*,18*d*.

In FIG. 6, a groove 21 is horizontally formed along the lower edge of the front surface of the upper frame rod 18*a*, and a groove 22 is horizontally formed along the upper edge of the front surface of the lower frame rod 18*b*.

A surface 21*a* between the lower edge of the front surface of the upper frame rod 18*a* and the groove 21 and a surface 22*a* between the upper edge of the front surface of the lower frame rod 18*b* and the groove 22 are grooved by thickness of an outward portion 25*b* of an edge piece 25. When the edge piece 25 engages with a corner between the lower surface and the front surface of the upper frame rod 18*a* and the front surface and with a corner between the upper surface and the front surface of the lower frame rod 18*b*, the end face of each of the edge piece 25 is coplanar with the front surfaces of the upper frame rod 18*a* and the lower frame rod 18*b*.

A mesh 23 may be preferably net-like or mesh-like material knitted or woven from high-tension plastic or other elastic fibers, or may be woven fabric, synthetic resin sheet or porous sheet. Synthetic resin edge pieces 24,24 which engage in a pair of grooves 19,20 are fixed in the left and right side edges of the mesh 23 by molding. The synthetic-resin edge pieces 25,25 which has a hook-like portions 25*d*,25*d* and engage in the grooves 21,22 are fixed in the upper and lower edges by molding.

The edge piece 25 comprises a base 25*a*, the outward portion 25*b*, and a turning portion 25*c* which turns in parallel with the base 25*a* from the end of the outward portion 25*b*. The base 25*a* and the outward portion 25*b* constitute the hook-like portion 25*d*.

The size of the mesh 23 mounted to the edge pieces 24,24, 25,25 is formerly determined to apply a suitable tension to the mesh 23 when the edge pieces 24,24,25,25 engage in the grooves 19,20 or the grooves 21,22.

In FIGS. 4-7, the right and left edge pieces 24,24 of the mesh 23 engage in the grooves 19,20 of the right and left side frame rods 18*c*,18*d*. The upper and lower ends of the mesh 23 are wound from the front surface to the rear surface around the upper and lower surfaces of the upper and lower frame rods 18*a*,18*b*. The hook-like portions 25*d*,25*d* of the upper and lower edge pieces 25,25 engage on the corner between the lower surface and the front surface, and the corner between the upper surface and the front surface. The turning portions 25*c*,25*c* of the upper and lower edge pieces 25,25 engage in the upper and lower grooves 21,22, so that the mesh 23 is stretched over the entire front surface of the front face frame 18 tensionally.

Thus, the front surface of the front face frame 18 or the front surface of the back frame 17 is entirely covered with the mesh 23. So the back frame 17 is not so occupied in the appearance of the chair, so that good impression is given in design.

In FIGS. 3 and 6, to each side end of the upper frame rod 18*a* of the front face frame 18, an arcuate upper reinforcement rod 26 is joined so that the middle of the rod 26 is spaced apart from the upper frame rod 18*a*. The upper reinforcement rod 26 and the upper frame rod 18*a* is like crescent.

The upper reinforcement rod 26 keeps strength of the upper part of the back frame 17 together with the back frame 17. When a user is reclined on the backrest 10, it is allowed for the upper frame rod 18*a* to be slightly flexed elastically.

Figure 8:
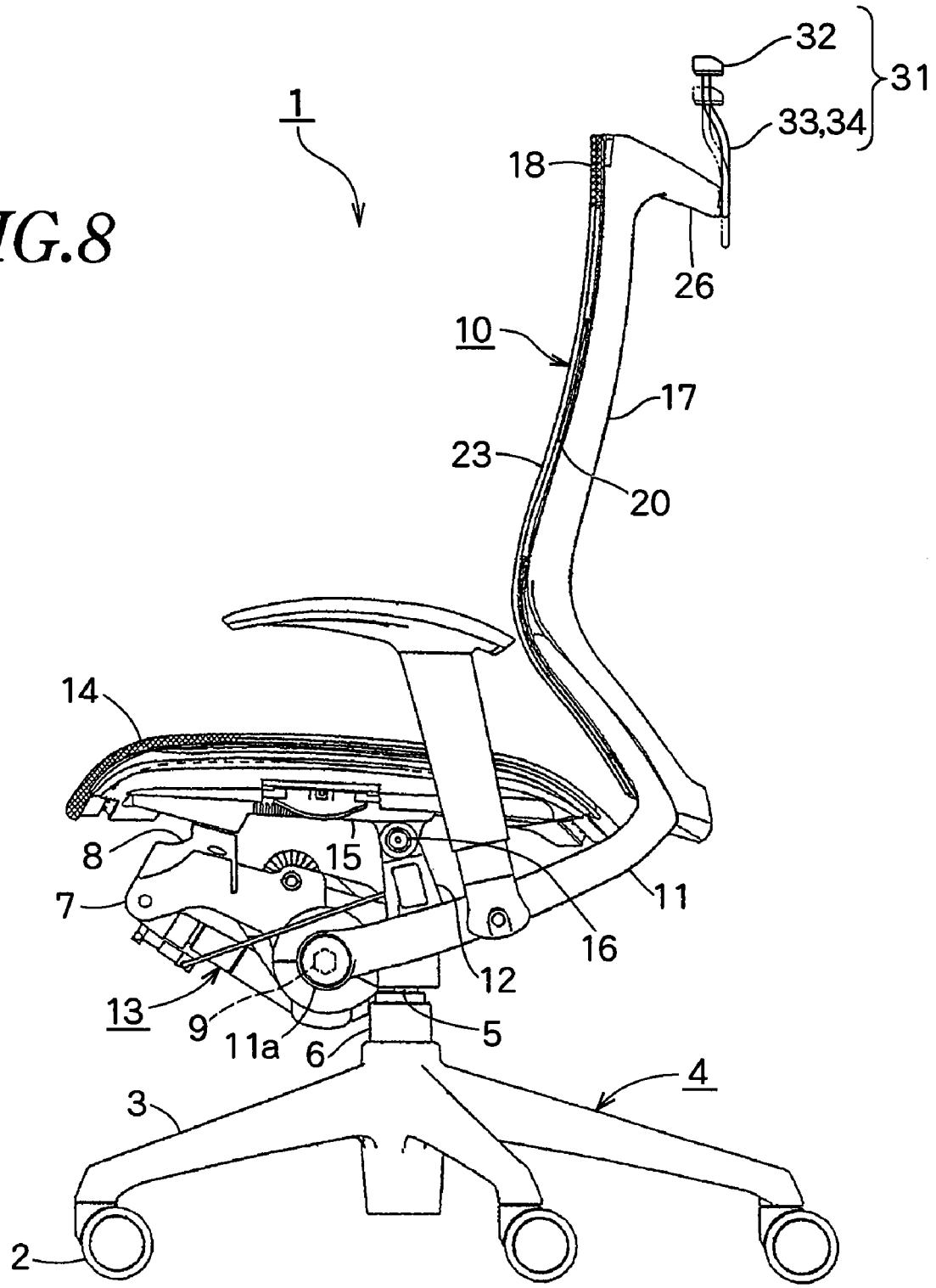
FIG. 8 is a side view of the second embodiment of a chair with a hanger according to the present invention.

The upper reinforcement rod 26 is spaced apart from the upper frame rod 18*a*. Thus, without hindering attachment of the mesh 23, a headrest 27 as shown by dotted lines in FIG. 4 and an optional member such as a hanger for clothes in FIG. 8 and so on are detachably mounted.

The upper reinforcement rod 26 is also used with a hand when the chair is moved.

In FIGS. 3, 6 and 7, to the lower ends of the right and left side frame rods 18*c*,18*d* of the front face frame 18, both ends of the lower reinforcement rod 28 are coupled. The middle of the lower frame rod 18*b* is spaced forward of the lower reinforcement rod 28, but each end thereof is fastened to each end of the lower reinforcement rod 28 with a screw 29.

The lower end of the mesh 23 is wound around the lower frame rod 18*b* after the lower frame rod 18*b* is fastened to the front surface of the lower reinforcement rod 28. A folding portion 25*c* of the lower edge piece 25 is engaged in the groove 22 of the lower frame rod 18*b*, so that the mesh 23 is mounted to the lower frame rod 18*b*.

When the chair is scrapped, a tool such as a screwdriver (not shown) is stuck through the mesh 23 and engaged with a head of the screw 29 which is loosened, so that the lower frame rod 18*b* is removed from the lower reinforcement rod 28. Thereafter, the upper edge of the mesh 23 and the right and left side edges are removed from the upper frame rod 18*a* and the right and left side frame rods 18*c*,18*d* with the edge members 25,24,24. The mesh 23 is separately removed from the back frame 17 and replaced with a new one.

When the chair is moved and hit with another chair, the lower frame rod 18*b* is protected by the lower reinforcement rod 28, so that the lower ends of the lower frame rod 18*b* and the mesh 23 are prevented from being damaged.

FIGS. 8-13 show the second embodiment in which a hanger is mounted to the chair in the first embodiment of the present invention. The basic structure of the chair is similar to the first embodiment, and the same numerals are allotted to the same members. Description thereof is omitted.

A chair 30 with a hanger in the second embodiment of the invention comprises a hanger 31 that moves up and down behind the backrest 10.

The hanger 31 comprises a hanger body 32 on which a suit can be hung; and a pair of support rods 33,34 which support the body 32. The support rods 33,34 are mounted on the backrest 10 with a mounting member 35 and a screw seat piece 36 by a screws 37.

The backrest 10 comprises the back frame 17 in which the mesh 23 in FIGS. 1-7 is stretched over the front face frame 18. The middle of the hanger 31 is spaced apart from the upper frame rod 18*a* of the front face frame 18, and each end of the hanger 31 is mounted to the middle of the upper reinforcement rod 26 connected to the upper frame rod 18*a*.

A pair of support rods 33,34 comprises parallel vertical rod portions 33*a*,34*a*; extending rod portions 33*b*,34*b* inclined upward of the vertical rod portions 33*a*,34*a*; and connecting portions 33*c*,34*c* curved downward of the vertical rod portions 33*a*,34*a*. The support rods 33,34 are connected at inner ends of the connecting portions 33*c*,34*c*.

The upper ends of the extending rod portions 33*b*,34*b* are plain. The extending rod portions 33*b*,34*b* are mounted to the right and left ends of the hanger body 32 with screws (not shown), so that the support rods 33,34 are fixed to the hanger body 32.

The extending rod portions 33*b*,34*b* of the support rods 33,34 are curved forward. So the hanger body 32 is positioned in front of the rear end of the upper reinforcement rod 26.

Figure 9:
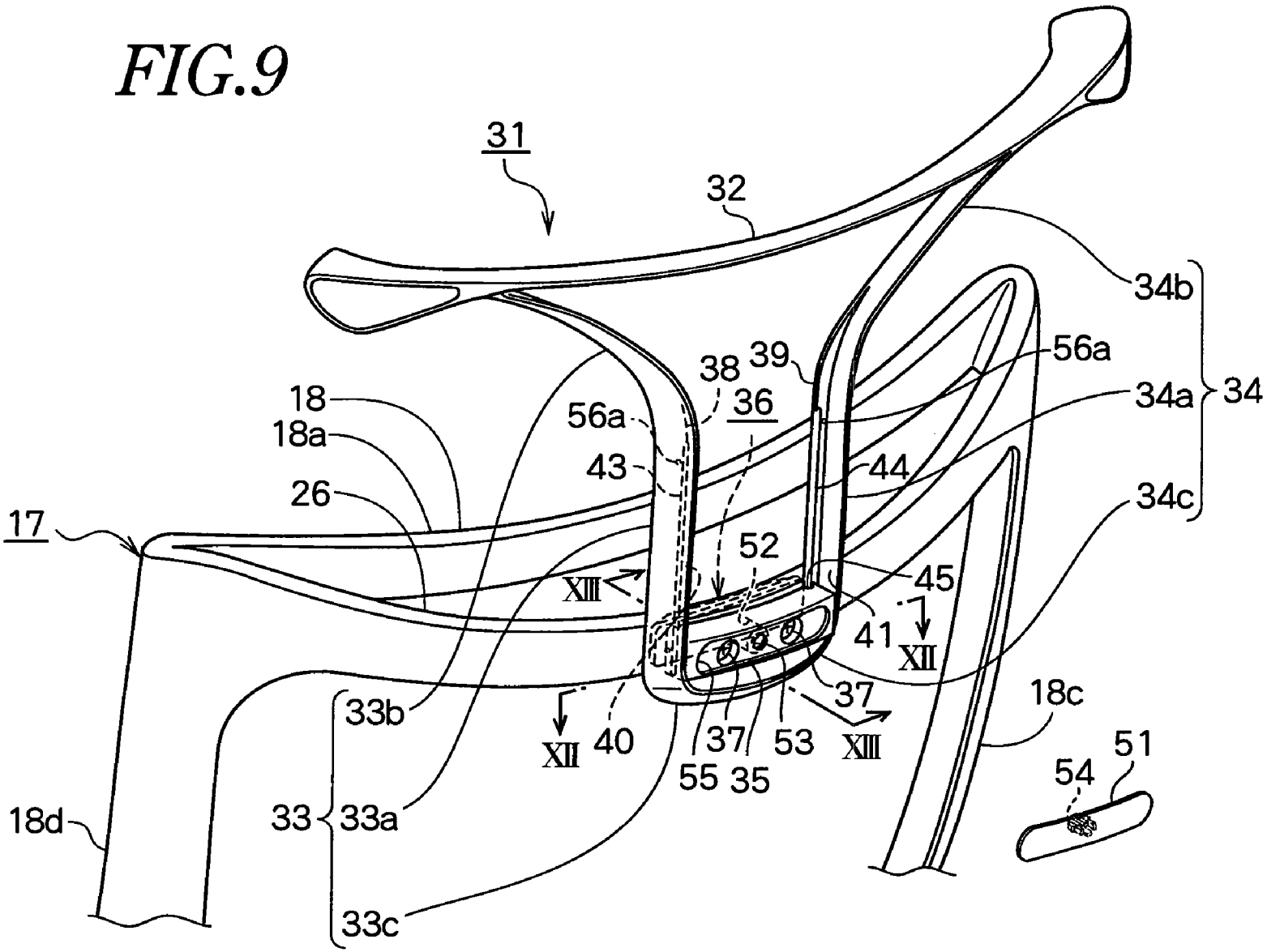
FIG. 9 is an enlarged rear perspective view of main part of the chair in FIG. 8.
Figure 12:
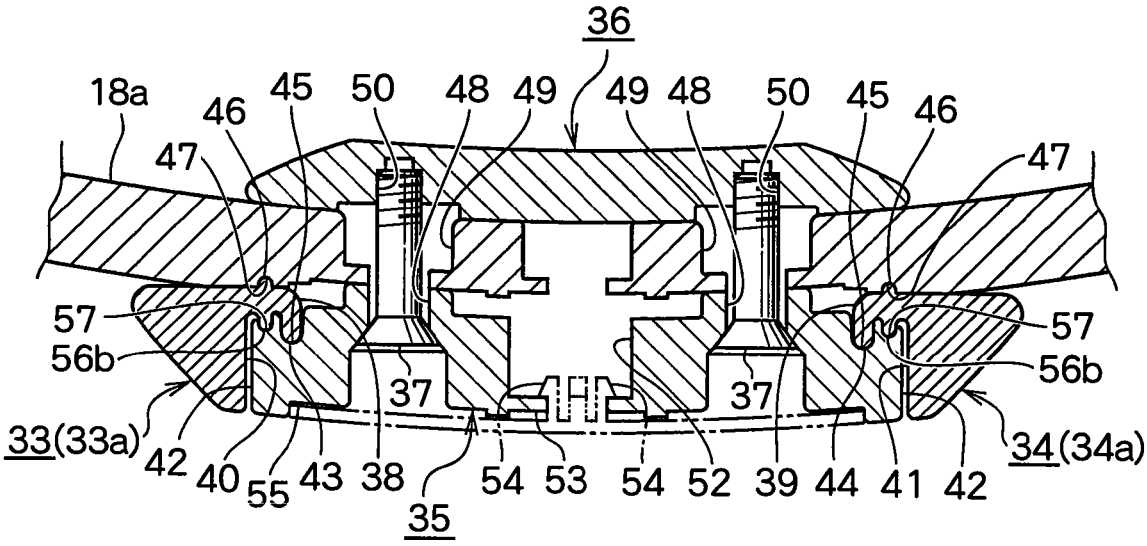
FIG. 12 is an enlarged sectional view taken along the line XII-XII in FIG. 9.
Figure 13:
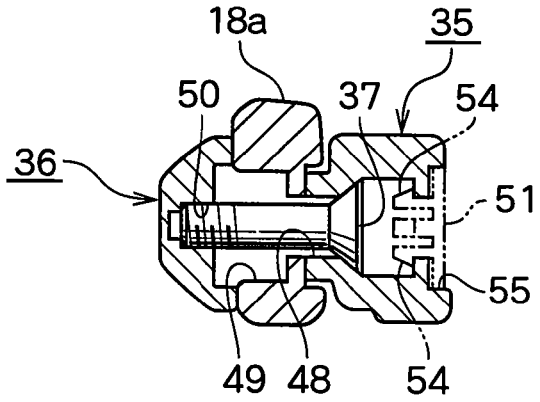
FIG. 13 is an enlarged sectional view taken along the line XIII-XIII in FIG. 9.

FIGS. 12 and 13 are enlarged sectional views taken along the line XII-XII and XIII-XIII in FIG. 9.

In FIGS. 9-12, plain portions 40,41 are formed on opposite surfaces 38,39 of the vertical rod portions 33*a*,34*a* of the right and left support rods 33,34.

A mounting member 35 comprises a thick rectangular plate. The right and left ends 42,42 are formed in size such that the mounting member 35 can engage in the plain portions 40,41 of the vertical rod portions 33*a*,34*a* of the right and left support rods 33,34.

On the inner side edges of the plain portions 40,41, vertical projections 43,44 are provided in parallel with each other.

The projections 43,44 engage in engagement grooves 45,45 on the front surface of the mounting member 35 so that the support rods 33,34 slidably move with respect to the mounting member 35.

Figure 11:
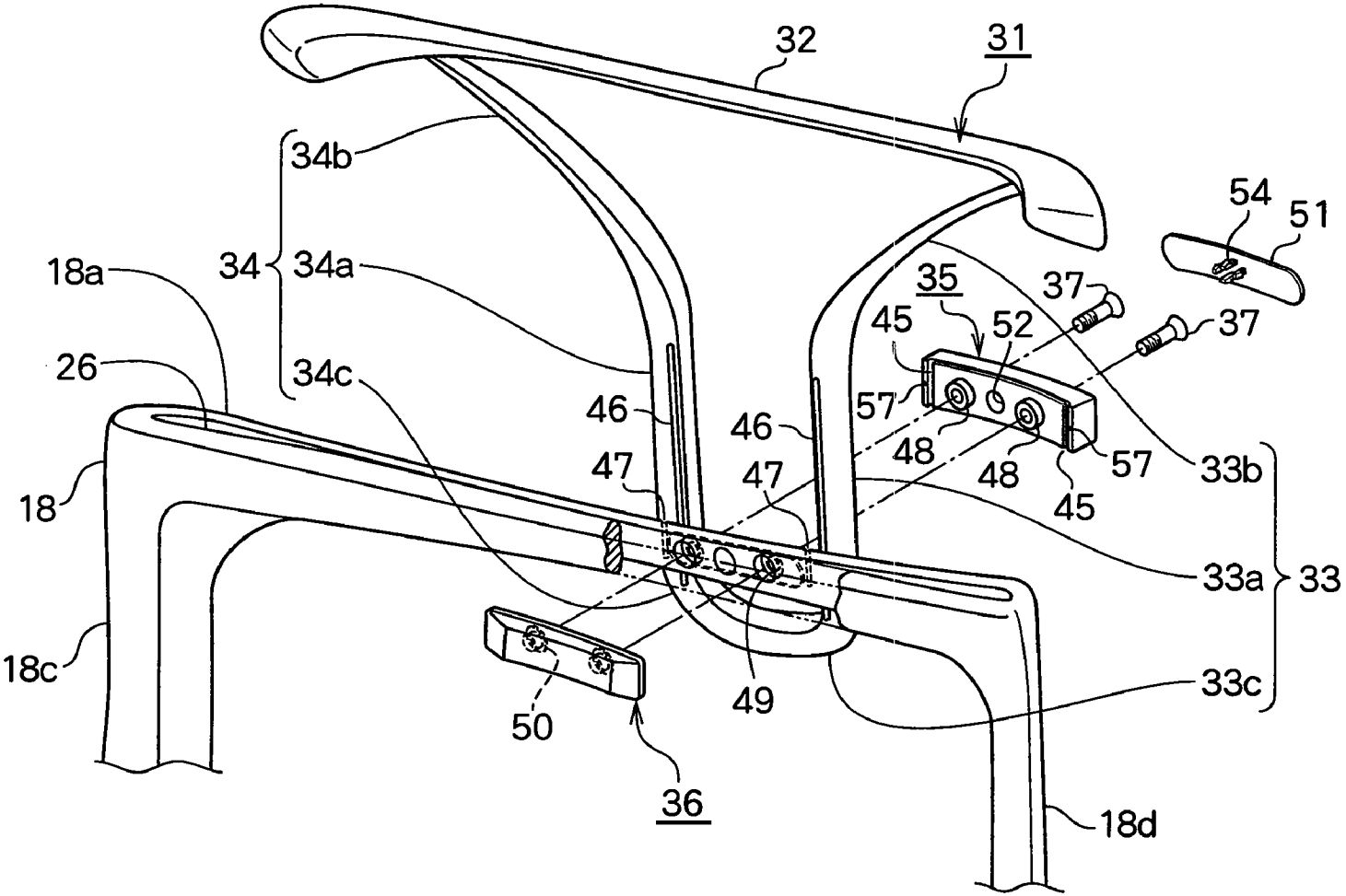
FIG. 11 is a front enlarged exploded perspective view thereof.

In FIGS. 11 and 12, vertical forward projections 46,46 are provided on the front surface of the vertical rod portions 33*a*,34*a* of the right and left support rods 33,34. On the rear surface of the upper reinforcement rod 26 of the backrest 10, vertical engagement grooves 47,47 are provided to engage with the forward projections 46,46.

Through holes 48,48 are formed in the mounting member 35, and through holes 49,49 are formed in the upper reinforcement rod 26. Blind bores 50,50 are formed in the rear surface of a screw seat piece 36 at a position corresponding to the through holes 48,48.

The hanger 31 will be mounted to the upper reinforcement rod 26 below.

The right and left support rods 33,34 having the hanger body 32 at the upper end contacts the upper reinforcement rod 26 to allow the forward projections 46,46 of the vertical rods 33*a*,34*a* of the support rods 33,34 to engage in the engagement grooves 47,47 on the rear surface of the screw seat piece 26, thereby positioning the support rods 33,34.

Then, the right and left ends of the mounting member 35 engage in the plain portions 40,41 of the vertical rod portions 33*a*,34*a* of the right and left support rods 33,34. In the engagement grooves 45,45 on the front surface of the mounting member 35, the projections 43,44 of the plain portions 40,41 of the vertical rod portions 33*a*,34*a* engage, and the mounting member 35 is positioned between the right and left vertical rod portions 33*a* and 34*a*.

Then, the screw seat piece 36 contacts the front surface of the upper reinforcement rod 26. While the support rods 33,34 are put between the upper reinforcement rod 26 and the mounting member 35, the upper reinforcement rod 26 is held between the mounting member 35 and the screw seat piece 36. The screws 37,37 pass into the blind bores 50 of the screw seat piece 36 through the through holes 48,49, so that the hanger 31 is mounted to move up and down with suitable resistance behind the backrest.

An engagement bore 52 for mounting a cover member 51 is formed in the middle of the mounting member 35. An inward projection 53 is provided on a rear edge of the engagement bore 52. The cover member 51 comprises a thin elongate plate and has in the middle an engagement claw 54 which is engagable with the inward projection 53 of the engagement bore 52.

On the rear surface of the mounting member 35, there is formed a recess 55 which engages with the cover member 51. The engagement claw 54 of the cover member 51 is put in the engagement bore 52 of the mounting member 35 to allow the claw 54 to engage on the inward projection 53. The entire cover member 51 engages in the recess 55, so that the cover member 51 is mounted to the mounting member 35.

The cover member 51 is also used as nameplate.

The hanger 31 is slidable up and down. When a suit is hung at an upper limit where the hanger slides, the hanger 31 moves down owing to the weight of the suit and the lower end of the suit contacts a floor, so that the suit is likely to become dirty.

Figure 10:
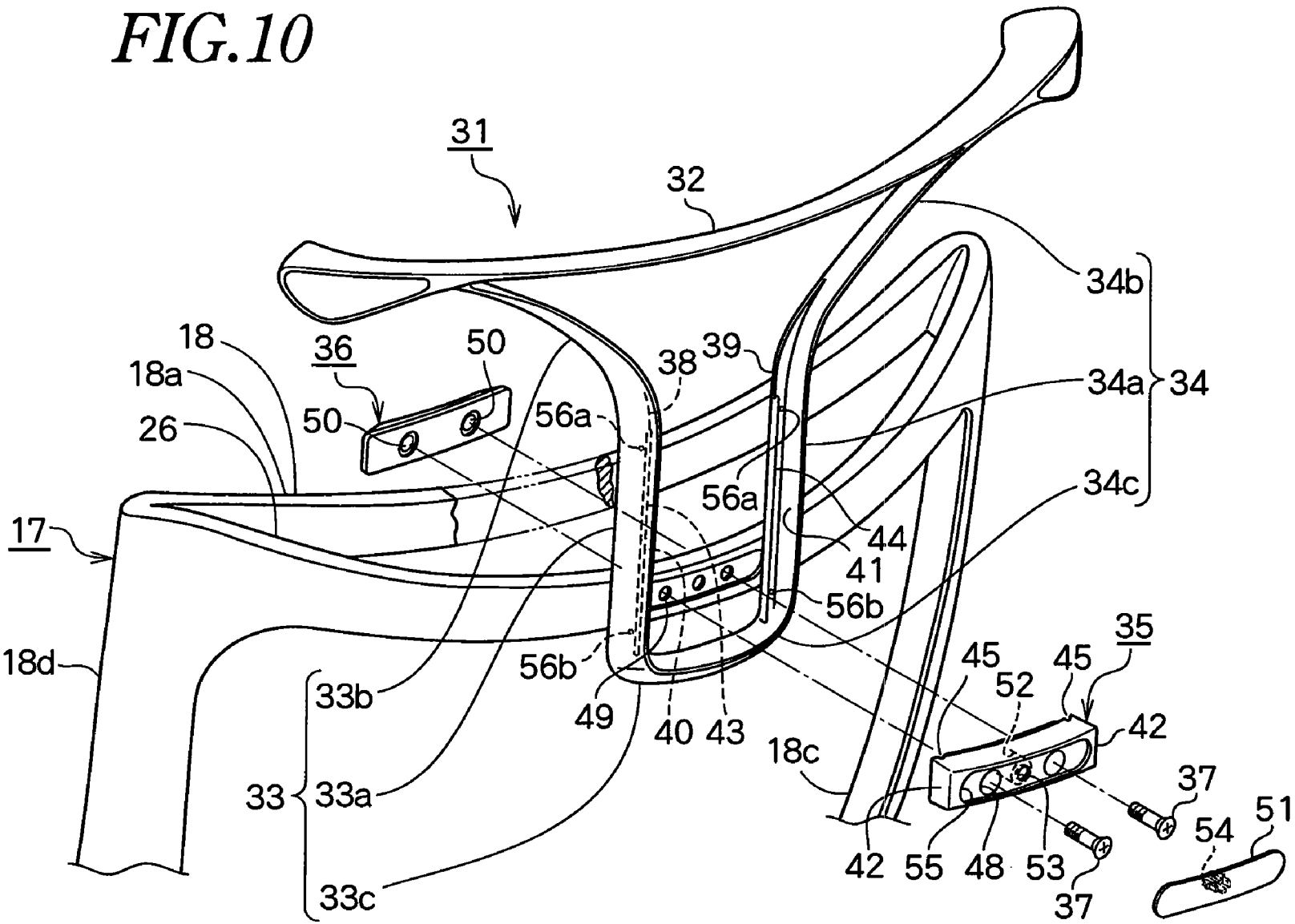
FIG. 10 is a rear enlarged exploded perspective view of the chair in FIG. 8.

For prevention, in FIGS. 10 and 12, a plurality of small rearward projections 56*a*,56*b* are provided on the vertical rod portions 33*a*,34*a*. and an engagement groove 57 which is elastically engagable with the small projections 56*a*,56*b* are provided in FIGS. 11 and 12. Thus, at a plurality of vertical positions where the small projections 56*a*,56*b* elastically engage in the engagement groove 57, the hanger can be held against a certain load.

By tightening the screw 37, the support rods 33,34 may be held between the upper reinforcement rod 26 and the mounting member 35. To change a height of the hanger 31, the screw 37 is loosened to allow the support rods 33,34 to move up and down. Thereafter, the screw 37 is tightened again to allow the hanger 31 to be held at a desired height.

Various modifications of the present invention may be possible without departing from the scope of claims.

For example, in the foregoing embodiment, the upper reinforcement rod 26 and the lower reinforcement rod 28 are mounted on the rear surface of the upper and lower frame rods 18*a*,18*b*. But the upper reinforcement rod 26 or the lower reinforcement rod 28 may be omitted.

In the foregoing embodiments, the present invention is applied to the stretching structure of the mesh 23 of the backrest 10 of the chair, but may be applied to a seat of a chair or a headrest.

The edge member 25 is made like a letter L and may engage to a corner between the lower surface and front surface of the upper frame rod 18*a* or lower frame rod 18*b*.

What is claimed is:

1. A chair comprising:

a seat;

a backrest including a back frame and a mesh having margins, the back frame comprising a front face frame, the front face frame including an upper frame rod positioned in a forward arc for securing the mesh, the upper frame rod configured as a single strip with ends and an upper reinforcement rod positioned behind the forward arc, the upper reinforcement rod configured as a single arcuate strip having a central section and ends; and a right frame rod extending along a right side of the backrest and a left frame rod extending along a left side of the backrest;

wherein the margins of the mesh are fixed to the front face frame so as to position the mesh to upholster the front face frame, and wherein the ends of the upper reinforcement rod and the ends of the upper frame rod each comprise part of an upper end of the right frame rod and the left frame rod, and the upper reinforcement rod is free of direct contact with any structure other than the right frame rod and the left frame rod so that the central section of the upper reinforcement rod is spaced apart and rearward from the upper frame rod.

2. A chair of claim 1, wherein said back frame further comprises an edge piece having a hook-like portion at an end, an upper part of the mesh being wound from a front surface of the upper frame rod to a rear surface around an upper surface, said edge piece engaging with a corner between a lower surface and the front surface of the upper frame rod so that said front face frame is upholstered with said mesh.

3. A chair of claim 2 wherein the front face frame further said right and left frame rods each has a vertical groove in an outer side surface, the edge piece to which the mesh is mounted engaging in the vertical groove so that said front face frame is upholstered with said mesh.

4. A chair of claim 3 wherein the upper frame rod is narrower than said right and left frame rods.

5. A chair comprising:

a seat;

a backrest including a back frame and a mesh having margins, the back frame comprising a front face frame, the front face frame including an upper frame rod positioned in a forward arc for securing the mesh, the upper frame rod configured as a single strip with ends and an upper reinforcement rod positioned behind the forward arc, the upper reinforcement rod configured as a single arcuate strip having a central section and ends; and a right frame rod extending along a right side of the backrest and a left frame rod extending along a left side of the backrest;

the front face frame including a lower frame rod configured as a single strip with ends, and a lower reinforcement rod configured as a single arcuate strip having a central section and ends, wherein the margins of the mesh are fixed to the front face frame so as to position the mesh to upholster the front face frame, wherein the ends of the upper reinforcement rod and the ends of the upper frame rod each comprise part of an upper end of the right frame rod and the left frame rod, and the upper reinforcement rod is free of direct contact with any structure other than the right frame rod and the left frame rod so that the central section of the upper reinforcement rod is spaced apart and rearward from the upper frame rod, and wherein the ends of the lower reinforcement rod and the ends of the lower frame rod each comprise part of a lower end of the right frame rod and the left frame rod, and the lower reinforcement rod is free of direct contact with any structure other than the right frame rod and the left frame rod so that the central section of the lower reinforcement rod is spaced apart and rearward from the lower frame rod.

6. A chair of claim 5, wherein said back frame further comprises a first edge piece having a hook-like portion at an end, an upper part of the mesh being wound from a front surface of the upper frame rod to a rear surface around an upper surface, said first edge piece engaging with a corner between a lower surface and the front surface of the upper frame rod so that said front face frame is upholstered with said mesh.

7. A chair of claim 6, wherein said right and left frame rods each has a vertical groove in outer side surface, the edge piece to which the mesh is mounted engaging in the vertical groove so that said front face frame is upholstered with said mesh.

8. A chair of claim 7, wherein the upper frame rod is narrower than said right and left frame rods.

9. A chair of claim 6, further comprising a second edge piece having a hook-like portion at an end, a lower part of the mesh being wound from a front surface of the lower frame rod to a rear surface around a lower surface, said edge piece engaging with a corner between an upper surface and the front surface of the lower frame rod so that said front face frame is upholstered with said mesh.

10. A chair of claim 9, wherein said right and left frame rods each has a vertical groove in outer side surface, the edge piece to which the mesh is mounted engaging in the vertical groove so that said front face frame is upholstered with said mesh.

11. A chair of claim 10, wherein the lower frame rod is narrower than said right and left frame rods.

12. A chair of claim 10, wherein the upper frame rod, said right and left frame rods and the lower reinforcement rod of the front face frame are integrally formed, each end of the lower frame rod being mounted to the lower reinforcement rod with a screw.

13. A chair comprising:

a seat;

a backrest including a back frame and a mesh having margins, the back frame comprising a front face frame, the front face frame including an upper frame rod positioned in a forward arc for securing the mesh, the upper frame rod configured as a single strip with ends and an upper reinforcement rod positioned behind the forward arc, the upper reinforcement rod configured as a single arcuate strip having a central section and ends; and a right frame rod extending along a right side of the backrest and a left frame rod extending along a left side of the backrest;

a headrest structure positioned in part above the backrest;

wherein the margins of the mesh are fixed to the front face frame so as to position the mesh to upholster the front face frame, and wherein the ends of the upper reinforcement rod and the ends of the upper frame rod each comprise part of an upper end of the right frame rod and the left frame rod, and the upper reinforcement rod is free of direct contact with any structure other than the right frame rod, the left frame rod and the headrest structure so that the central section of the upper reinforcement rod is spaced apart and rearward from the upper frame rod.

14. A chair of claim 13, wherein the upper frame rod, the right frame rod and the left frame rod are integrally formed.

* * * * *